United States Patent [19]

Matsunaga

[11] 4,093,140

[45] June 6, 1978

[54] METHOD OF RECOILING SLIT MATERIAL

[75] Inventor: Douglas S. Matsunaga, Chicago, Ill.

[73] Assignee: Braner Enterprises, Inc., Schiller Park, Ill.

[21] Appl. No.: 770,804

[22] Filed: Feb. 22, 1977

[51] Int. Cl.[2] ..... B65H 35/02; B65H 23/10

[52] U.S. Cl. ..... 242/56.2; 242/75.2

[58] Field of Search ..... 242/56.2, 78.1, 75.2, 242/74, 75.43, 67.1 R; 226/39, 195

[56] References Cited

U.S. PATENT DOCUMENTS

| | | | |
|---|---|---|---|
| 3,222,044 | 12/1965 | Crowe | 242/56.2 X |
| 3,386,679 | 6/1968 | Foulon | 242/56.2 |
| 3,771,738 | 11/1973 | Abbey | 242/75.2 |
| 3,883,088 | 5/1975 | Connon | 242/75.2 |

*Primary Examiner*—Edward J. McCarthy

[57] ABSTRACT

A method by which multiple strands of slit metal material are wound upon the rotating drum of a recoiler. Frictional contact between the recoiler drum and strands cause the strands to be coiled about the drum with relative movement between the recoiler drum and the separate coils of strands occurring to accommodate the varying thicknesses of the individual strands so that the strands are wound upon the drum at substantially the same linear speed.

4 Claims, 5 Drawing Figures

METHOD OF RECOILING SLIT MATERIAL

BACKGROUND OF THE INVENTION

This invention relates to a method of recoiling metal material cut into individual strands by a slitter.

Metal procedures manufacture sheets of metal material in coiled form having a substantial width. Generally before such coiled metal can be utilized for fabrication purposes it must be cut by a slitter into strips or strands of desired width and recoiled for shipping and handling. Due to the manner in which the large coils of metal sheeting are produced, the cross sectional thickness of the sheets varies from a maximum in its center to a minimum at each of its opposite sides. Thus, when such a coiled sheet of metal is slit into strands, the thickness of some strands will exceed the thickness of the other strands. Heretofore strands of slit metal sheet material have been coiled by being attached to the drum of a recoiler and wound thereupon by rotation of the drum. Due to the varying thicknesses of the strands, those strands of greater thickness will be wound at greater linear speed then those strands of lesser thickness which causes the thinner strands to appreciably sag between the slitter and recoiler. To accommodate such sagging strands of metal material, a pit is commonly dug between the slitter and recoiler for receiving such strands. In addition to a pit for receiving the sagging strands of slit material, elaborate tensioning devices have been incorporated in prior art metal slitting lines for the purpose of maintaining separation between the strands and properly tensioning the strands prior to being wound upon the recoiler. Examples of such devices are disclosed in U.S. Pat. No. 3,883,088 and 3,672,595.

A similar problem regarding the lack of uniformity in linear winding speed for slit material has been encountered when slitting webs of plastic or similar non-metallic material and rewinding the slit material into thin rolls. U.S. Pat. No. 2,985,398 is an example of the elaborate rewinding systems devised to equalize the linear speed at which such slit material is rewound into rolls.

In the following described invention an economical and simplified method for rewinding slit metal material is disclosed in which existing slitting apparatus can be utilized without the need for a pit between the slitter and recoiler and elaborate tensioning devices.

SUMMARY OF THE INVENTION

In the method of this invention the ends of the strands of slit metal material are secured to the drum of the recoiler and the drum rotated to cause at least one turn of each strand to be placed about the drum. The recoiler drum is then stopped and the ends of the strands released. The drum is again rotated with the first turns of the strands remaining in sufficient frictional contact with the drum to cause the strands to be coiled upon the drum as the metal sheet material passes through the slitter. Tension is applied to the strands to cause those coils of strands having the larger diameter because of the greater strand thickness to rotate relative to as well as with the recoiler drum. This slippage between the drum and coiled strands allows all of the strands to be wound at substantially the same linear speed, thereby eliminating appreciable sagging of strands between the slitter and recoiler.

Accordingly, it is an object of this invention to provide a method of coiling multiple strands of slit material upon the drum of a recoiler at substantially the same linear speed.

Another object of this invention is to provide a method of coiling slit metal material of varying cross-sectional thickness without the strands of such material appreciably sagging between the slitting device and recoiler.

Another object of this invention is to provide a method of coiling multiple strands of slit material in which the tension upon such material as it passes through the slitting device is generally uniform.

Other objects of this invention will become apparent upon a reading of the invention's description.

BRIEF DESCRIPTION OF THE DRAWINGS

A preferred embodiment of this invention has been chosen for purposes of illustration and description wherein.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable others skilled in the art to best utilize the invention.

Figure 1:
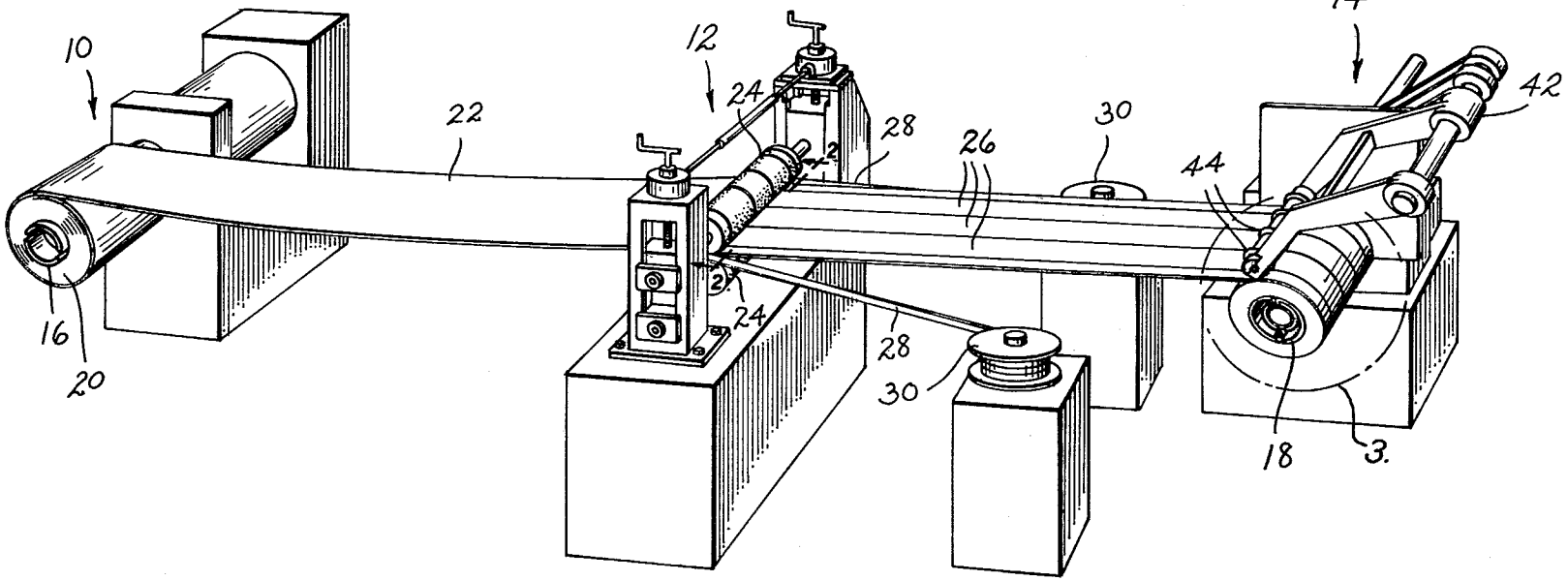
FIG. 1 is a perspective view of a slitting line.
Figure 2:
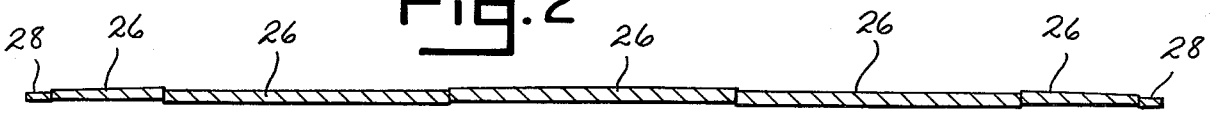
FIG. 2 is a cross sectional view of the slit metal material as it emerges from the slitter and as taken along line 2—2 of FIG. 1.
Figure 3:
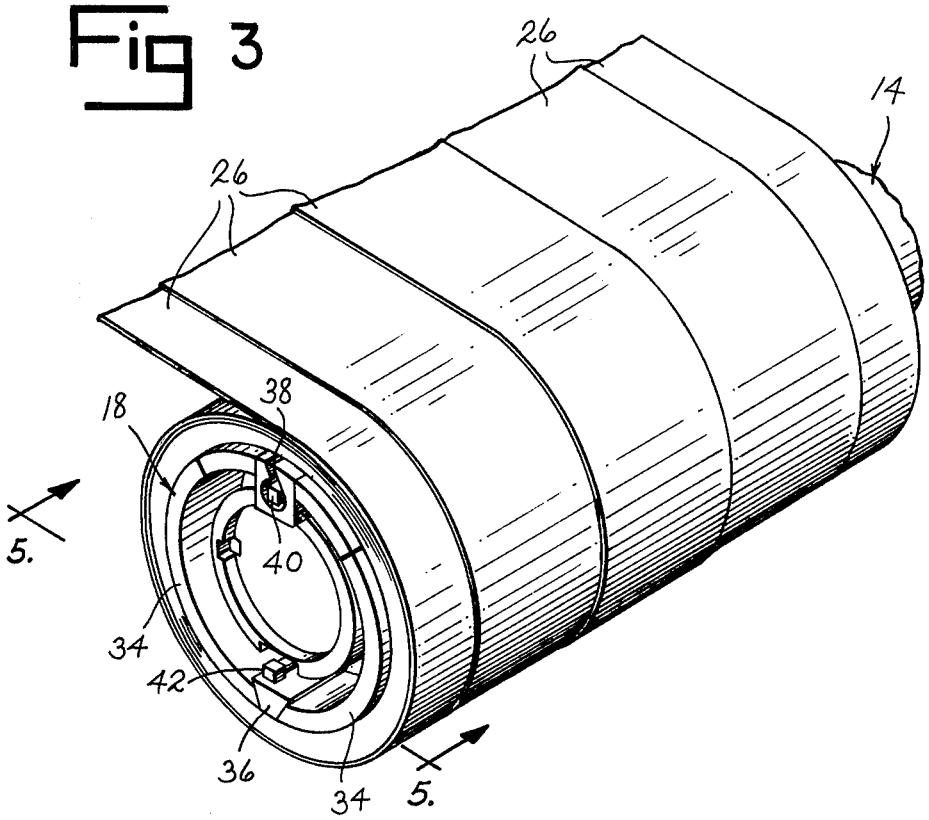
FIG. 3 is a detailed perspective view showing the slit metal material being wound upon the drum of the recoiler.
Figure 4:
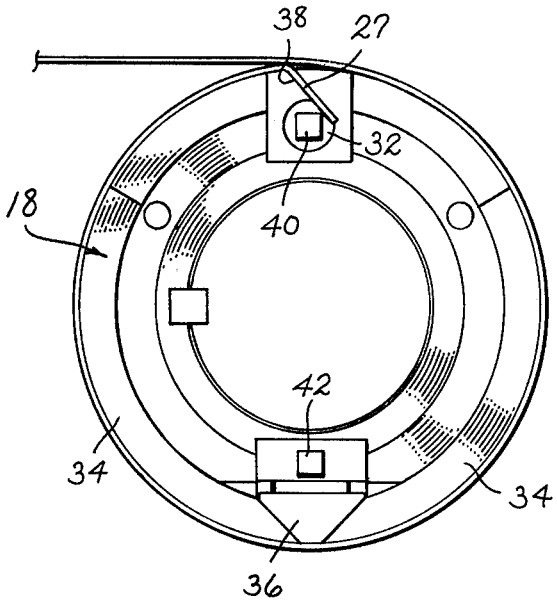
FIG. 4 is an end view of the recoiler drum showing the slit material being initially wound upon the drum.
Figure 5:
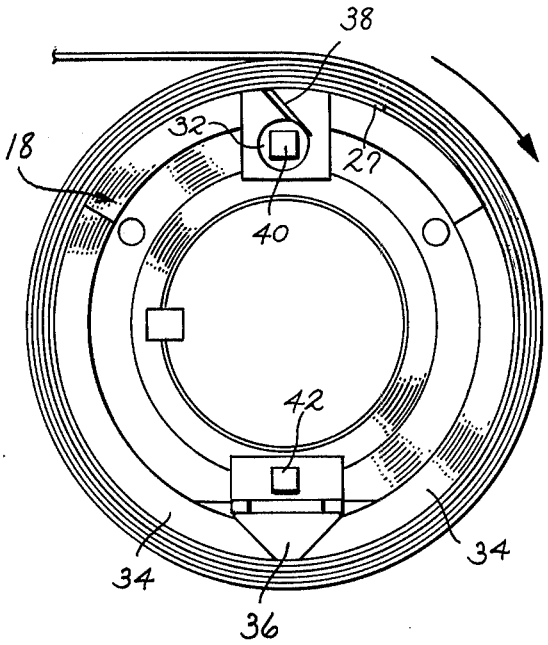
FIG. 5 is an end view of the recoiler drum as seen from line 5—5 of FIG. 3 and showing the slit metal material being coiled upon the drum.

The slitting line shown in FIG. 1 includes an uncoiler 10, slitter 12, and a recoiler 14. Uncoiler 10 includes a mandrel or drum 16, and recoiler 14 includes a mandrel or drum 18. Both drums 16 and 18 are individually motor driven. A coil 20 of rolled sheet metal is placed upon drum 16 of uncoiler 10 and the drum expanded so as to secure the coil to the drum. Sheet material 22 of coil 20 is then fed through arbors 24 of slitter 12 where cutters slit the sheet material into strands 26 of selected width. Strands 26 are then wound upon drum 18 of recoiler 14, removed from the recoiler, banded and prepared for use or shipment. Any trim strips 28 formed at the edges of sheet material 22 will be coiled upon individual scrap winders 30. Uncoiler 10, slitter 12, recoiler 14 and scrap winders 30 may be any of a variety of commercially available constructions, with drum 18 of recoiler 14 being provided with a gripper 32 for securing the strand end to the drum and expandable side wall parts 34 which are normally spring urged together and are expandable by a wedge member 36. As thus far described, the slitting operation is of a common, well known prior art procedure.

The method of this invention relates to the manner in which strands 26 are coiled upon recoiler drum 18.

In the practice of this invention, after initially feeding sheet material 22 through slitter 12, the ends 27 of strands 26 are each inserted into gripper slot 38 in drum 18 of recoiler 14 and nut 40 rotated to cause gripper bar 32 to be cammed into securing contact with the strand ends 27. The motor of recoiler 14 is then actuated to cause strands 26 to be wound about the exterior surface of recoiler drum 18 for at least one and preferably two or three turns with additional sheet material 22 being pulled from coil 20 and through slitter 12. Drum 16 of uncoiler 10 which carries coil 20 may either freely rotate or be motor driven during the initial winding of strands 26 about recoiler drum 18. Recoiler drum 18 is then stopped and nut 40 rotated to cause gripper bar 32 to release the ends 27 of strands 26. While braking drum 16 of uncoiler 10 to prevent its rotation, drum 18 of recoiler 14 is again rotated to cause ends 27 of strands 26 to be pulled from gripper slot 38, with drum 18 rotating within or relative to the overlying windings of the strands. During the initial winding of strands 26, recoiler drum 18 may be slightly expanded. This is accomplished by rotating camming nut 42, which in turn cams wedge member 36 radially outwardly to cause the diametrical expansion or outward pivoted movement of side wall parts 34 of the drum 18. By having drum 18 slightly expanded during the initial winding of strands 26, side wall parts 34 of the drum can be retracted by the withdrawal of wedge member 36 after ends 27 of the strands are released from gripper bar 32 to assure controlled relative movement between drum 18 and the overlying strand windings during the following described steps of this invention.

The brake upon uncoiler drum 16 is then slowly released, while the rotational speed of recoiler drum 18 is increased to cause strands 26 to be wound upon themselves around drum 18. There is sufficient frictional resistance between the outer surface of recoiler drum 18 and the innermost winding of strands 26 to cause the strands to rotate with the recoiler drum and draw sheet material 20 through slitter 12. Recoiler drum 18 is preferably rotated at a constant speed, with the brake to uncoiler drum 16 being selectively applied to place tension upon the strands between slitter 12 and the recoiler drum. The braking of recoiler drum 16 and the friction between recoiler drum 18 and the overlying windings of the strands in applying tension to the strands 26 is so correlated that while each coil of wound strands will rotate with the drum there will also be rotative movement of the drum within the coils of those strands of greater thickness. Relative rotation between recoiler drum 18 and rotating coils of strands 26 also may occur with those strands of lesser thickness due to the difficulty in perfectly correlating the tension applied to and drum friction of strands 26. Such relative rotational movement between recoiler drum 18 and each of the rotating coils of strands 26 is acceptable and could even be desired in some circumstances. Due to relative rotational movement between the rotating strand coils and recoiler drum 18, each strand 26 will be wound upon the drum at substantially the same linear speed regardless of the diametrical size of the strand coils.

As the coils of strands 26 increase in diameter upon recoiler drum 18, it may be necessary to expand the drum so as to increase the frictional resistance between the outer surface of the drum and the inner windings of the coiled strands in order to maintain rotation of the strand coils. Separation between adjacent coils of strands 26 upon recoiler drum 18 is maintained during operation of the recoiler through the standard recoiler over-arm 42 which carries separators 44. Separators 44 extend between the strand coils to prevent coil to coil contact.

When the slitting operation is completed, the exterior ends of coiled strands 26 will be aligned across recoiler drum 18 and can be easily and quickly taped to the coiled strands in preparation for removal of the coils from drum 18 and subsequent strapping. By providing for relative rotative movement between the recoiler drum and rotating strand coils, equal tension is placed upon all the strands. This equalness in tension prevents stretching of some strands which have been common when using prior art recoiling methods in which sagging of the strands occur. Also by applying a generally even tension upon all strands 26 as they are being wound upon recoiler 14, sheet material 22 is pulled more evenly through slitter 12.

After strands 26 have been fully wound upon recoiler drum 18 and the drum stopped with the outer ends of the strands taped, the coils of strands may be pushed off of or pulled from the exterior end of drum 18. To facilitate the removal of the coiled strands from drum 18, side parts 34 of the drum may be retracted to provide additional clearance between the outer surface of the drum and the inner turns of the coiled strands.

Depending upon the type of metal material being wound upon recoiler drum 18, it may be necessary to apply a lubricant, such as oil, grease or silicone, to the drum prior to the initial wrapping of strands 26 about the drum outer surface and during the recoiling operation. Such a lubricant is not applied in quantities to prevent rotation of the coiling strands with the drum. It is applied to control the frictional resistance between the recoiler drum and strand coils so as to make it easier to regulate the tension on the strands between the slitter and recoiler, as well as to reduce the heat generated between the drum and strand coils.

The method of this invention has been used to recoil strands of slit 24 gauge steel at a linear speed of approximately 1,000 feet per minute. It is anticipated that this invention can be utilized without difficulty to recoil slit 16 gauge steel at speeds between 200 and 2,000 linear feet per minute.

It is to be understood that the invention is not to be limited to the details above given, but may be modified within the scope of the appended claims.

What I claim is:

1. In a slitting line including an uncoiler, a slitter and a recoiler having a rotatable drum, a coil of metal material carried by said uncoiler, said material extending through said slitter and being cut thereby into multile strands, and strands varying in thickness, the method of coiling said strands comprising the steps:

(a) securing the ends of each strand to said recoiler drum;

(b) rotating said recoiler drum to coil at least one turn of each strand around said drum;

(c) releasing the end of each strand from said drum with said first turns of the strands remaining in contact with the drum; and (d) rotating said drum in frictional contact with said strand first turns to impart winding rotation to the strands with said drum rotating relative to at least one of said strands to cause each of the strands to be wound upon said drum at substantially the same linear speed as said sheet material is uncoiled during rotation of said uncoiler and passes through said slitter.

2. The method of claim 1 wherein step (*d*) includes rotating said drum at a constant speed and selectively varying the speed of rotation of said uncoiler to vary the speed of rotation of said drum relative to at least one of said strands.

3. The method of claim 2 wherein said drum is diametrically expandable and includes the step of increasing the diameter of said drum to increase the frictional resistance between said drum and wound strands thereon while maintaining relative rotation between the drum and at least one of said strands.

4. The method of claim 2 and including the step of applying a lubricant between said drum and first turns of said strands to facilitate relative rotation between the drum and strand first turns while said strands are wound upon said drum.

* * * * *